US012234696B1

(12) United States Patent
Seren et al.

(10) Patent No.: US 12,234,696 B1
(45) Date of Patent: Feb. 25, 2025

(54) DOWNHOLE ROBOTS WITH DISSOLVABLE FAIL-SAFE BALLAST

(71) Applicant: ARAMCO SERVICES COMPANY, Houston, TX (US)

(72) Inventors: Huseyin Rahmi Seren, Houston, TX (US); Christopher Powell, Houston, TX (US); Mohamed Larbi Zeghlache, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/455,529

(22) Filed: Aug. 24, 2023

(51) Int. Cl.
*E21B 23/00* (2006.01)
*B63B 22/08* (2006.01)
*B63B 22/10* (2006.01)

(52) U.S. Cl.
CPC ..... *E21B 23/00* (2013.01); *B63B 22/08* (2013.01); *B63B 22/10* (2013.01); *E21B 2200/08* (2020.05)

(58) Field of Classification Search
CPC ..... E21B 2200/08; B63B 22/10; B63B 22/08
See application file for complete search history.

(56) References Cited

U.S. PATENT DOCUMENTS 7,168,494 B2 1/2007 Starr et al.
10,337,279 B2 7/2019 Frazier
10,352,125 B2 7/2019 Frazier
10,465,468 B2 11/2019 Frazier et al.
10,900,351 B2 1/2021 Deffenbaugh et al.
11,125,039 B2 9/2021 Kellner
11,572,751 B2 2/2023 Musso
2015/0107855 A1* 4/2015 Murphree ..... E21B 33/134 166/381
2016/0320769 A1* 11/2016 Deffenbaugh ..... E21B 23/10
2017/0067328 A1 3/2017 Chauffe et al.
2018/0306027 A1 10/2018 Sherman et al.
2018/0363409 A1 12/2018 Frazier
2020/0131899 A1* 4/2020 Chen ..... E21B 47/10
2020/0170284 A1* 6/2020 Sato ..... B63B 22/04
2023/0038860 A1 2/2023 Seren et al.

FOREIGN PATENT DOCUMENTS

WO 2016/032761 A1 3/2016
WO 2020/220087 A1 11/2020
(Continued)

OTHER PUBLICATIONS

Buzi, Erjola et al., "Sensor Ball: An Autonomous Untethered Logging Platform"; Proceedings of the Offshore Technology Conference; Paper No. OCT-30538-MS; pp. 1-10; May 4, 2020 (10 pages).

(Continued)

*Primary Examiner* — Giovanna Wright
(74) *Attorney, Agent, or Firm* — Osha Bergman Watanabe & Burton LLP

(57) ABSTRACT

An untethered device includes a tool and a ballast weight. The ballast weight includes an attachment plate that is securable to the tool, a dissolvable ballast, and attachment elements that secure the dissolvable ballast to the attachment plate. At least one of the attachment elements is dissolvable to release the dissolvable ballast from the attachment plate.

20 Claims, 4 Drawing Sheets

(56) References Cited

FOREIGN PATENT DOCUMENTS

| | | |
|---|---|---|
| WO | 2022/011388 A1 | 1/2022 |
| WO | 2024/148015 A1 | 7/2024 |

OTHER PUBLICATIONS

Terves Inc., "Dissolvables"; <https://www.tervesinc.com/products/dissolvables/>; Accessed Aug. 23, 2023 (6 pages).
Bubbletight, LLC, "Dissolvable Metals, Rubber & Polymers"; <http://bubbletightusa.com/products/>; Accessed Aug. 23, 2023 (9 pages).
Zhao, Lei et al., "Advanced Compound Coating for Delaying Corrosion of Fast-Dissolving Alloy in High Temperature and Corrosive Environment"; World Academy of Science, Engineering and Technology; International Journal of Materials and Metallurgical Engineering; vol. 15, No. 2; pp. 71-75; 2021 (5 pages).
Seren, Huseyin R. et al., "Electro-permanent magnetic weight release mechanism for buoyancy control of an autonomous well-logging tool"; AIP Advances; vol. 11, Issue 2, Article 025117; pp. 025117-1-025117-7; Feb. 2021 (7 pages).
Chen, Ting et al., "Synthesis of Disruptive Technologies Leads to Design of Flowable Sensors for Reservoir Monitoring, Passively Retrievable Through Carrier Buoyancy"; Proceedings of the Offshore Technology Conference; Paper No. OTC-29599-MS; pp. 1-12; Apr. 26, 2019 (12 pages).
Seren, Huseyin R. et al., "An Untethered Sensor Platform for Logging Vertical Wells"; IEEE Transactions on Instrumentation and Measurement; vol. 67, Issue 4; pp. 798-803; Apr. 2018 (6 pages).
Gibson, Chad Michael Erick, "Novel Frac Sleeve Technology Designed to Replace Plug N Perf and Improve Efficiencies While Significantly Reducing Time to Production and Environmental Impact"; Proceedings of the ADIPEC; Paper No. SPE-211006-MS; pp. 1-20; Oct. 31, 2022 (20 pages).
Seren, Huseyin R. et al., "Miniturized Casing Collar Locator for Small Downhole Robots"; IEEE Sensors Letters; vol. 6, Issue 4, Article Sequence No. 6000804; Apr. 2022 (4 pages).
Seren, Huseyin R. et al., "Autonomous Well Logging Robot with Passive Locomotion"; 2021 21st International Conference on Control, Automation and Systems (ICCAS 2021); pp. 857-862; 2021 (6 pages).
Zeghlache, Mohamed Larbi et al., "Sensor-Ball: Field Deployment of Autonomous and Untethered Surveillance"; Proceedings of the International Petroleum Technology Conference; Paper No. IPTC-22255-MS; pp. 1-14; Feb. 21, 2022 (14 pages).
Seren, Huseyin et al., "Magnetic Sensors for Navigation of Untethered Downhole Robots"; Proccedings of the Middle East Oil, Gas, and Geosciences Show; Paper No. SPE-213358-MS; pp. 1-9; Mar. 7, 2023 (9 pages).
Carpenter, Chris, "Autonomous Intelligent Logging Platform Enables Cost and Time Savings"; Journal of Petroleum Technology; vol. 75, Issue 01, Paper No. SPE-0123-0086-JPT; pp. 86-88; Jan. 2023 (3 pages).
International Search Report and Written Opinion issued in corresponding International Application No. PCT/US2024/042368, dated Nov. 20, 2024 (15 pages).

* cited by examiner

DOWNHOLE ROBOTS WITH DISSOLVABLE FAIL-SAFE BALLAST

BACKGROUND

Untethered devices in oil and gas applications refer to untethered logging, intervention, stimulation, or other devices that are unattached to a wellbore surface and are deposited in a wellbore to descend in a downhole direction. Such an untethered device may include a release mechanism whereby an exposed ballast weight degrades or is released at a downhole depth along the wellbore to reduce a density of untethered device for allowing the untethered device to float back upward to the surface. The release mechanism may include an attachment plate that, owing to its weight, settles permanently in a bottomhole region of the wellbore, or may flow back to the surface. An accumulation of such attachment plates at the bottomhole region (e.g., especially because the attachment plates do not erode quickly) can lead to wellbore cluttering, which hinders various wellbore interventions and bottomhole operations. Furthermore, heat produced by the highly exothermic reaction undergone by the exposed ballast weight can permanently damage the other components of the untethered device while attached to the ballast weight. Also, if the ballast release actuator of the tool fails, it may take long time for the tool to regain its buoyancy once a sufficient portion of the ballast has dissolved. The dissolution time may be unpredictable, as it depends on factors such as volume, and surface area of the ballast and salinity, pH, and temperature of the borehole fluid. Finally, emerging byproducts of the dissolving aluminum can form a muddy aggregate which can reach a volume where the dissolvable tool can be immobilized due to the large viscosity of the mud.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to an untethered device comprising: a tool; and a ballast weight comprising: an attachment plate that is securable to the tool, a dissolvable ballast, and attachment elements that secure the dissolvable ballast to the attachment plate, wherein at least one of the attachment elements is dissolvable to release the dissolvable ballast from the attachment plate.

In general, in one aspect, embodiments relate to a method for logging a wellbore, the method comprising: dropping an untethered device in a downhole direction through the wellbore, the untethered device comprising: a tool, and a ballast weight comprising: an attachment plate that is securable to the tool, a dissolvable ballast, and attachment elements that secure the dissolvable ballast to the attachment plate, dissolving an attachment element to release the dissolvable ballast from the attachment plate; and moving the tool in an uphole direction through the wellbore.

In light of the structure and functions described above, embodiments of the disclosure may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for an untethered logging, intervention, stimulation, and/or other operations, using downhole robots or other untethered tools that are unattached to a wellbore surface and are deposited in a wellbore to descend in a downhole direction.

An untethered tool in accordance with embodiments of the disclosure relies on a ballast to sink in the downhole environment. The ballast may be released to change the buoyancy of the untethered tool, enabling the untethered tool to rise to the surface. In one embodiment, a switchable magnet is used to hold or release the ballast.

The ballast may be dissolvable (or disintegrating, or degrading) to prevent cluttering inside the well as released ballasts can aggregate over time, and to provide a fail-safe mechanism in case the weight release function fails due to any reason.

In one or more embodiments, additional dissolvable components are used to separate the functions of the dissolvable ballast and a dissolvable fail-safe system. These additional dissolvable components may dissolve prior to dissolution of the ballast, enabling a release of the ballast prior to dissolution of the ballast. A detailed description is subsequently provided in reference to the figures.

Figure 1:
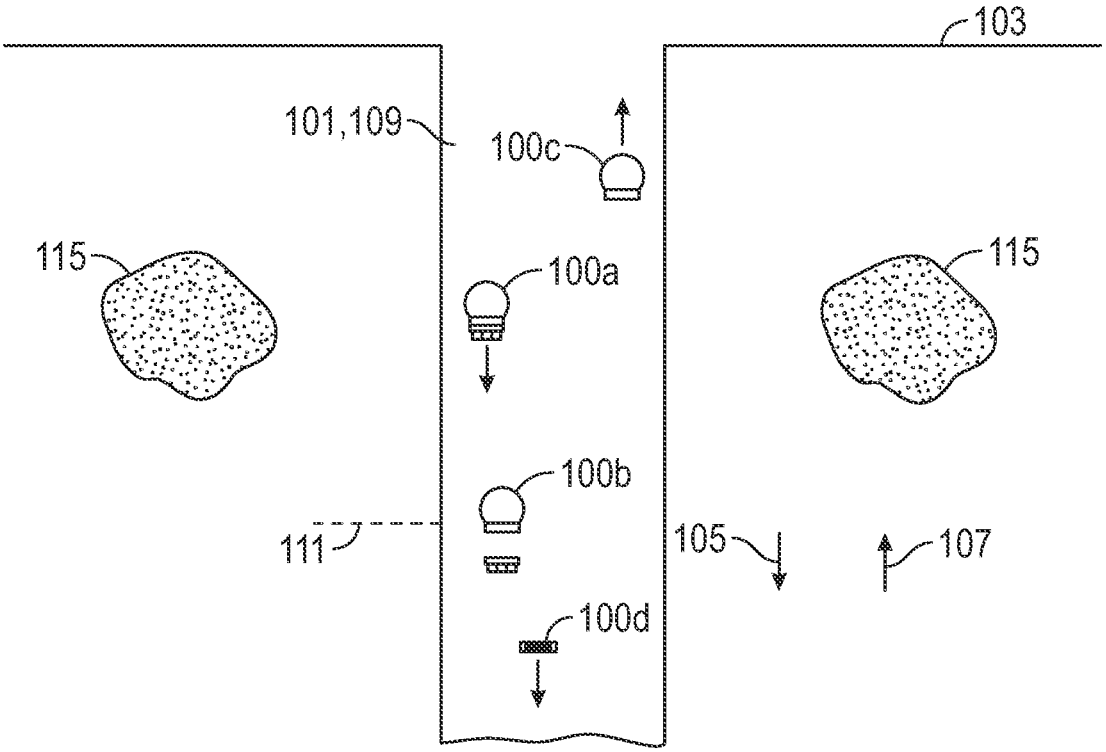
FIG. 1 shows several states of example untethered devices, in accordance with embodiments of the disclosure.

FIG. 1 shows several states of example untethered devices (100) (e.g., 100*a*, 100*b*, 100*c*, 100*d*) for measuring properties (e.g., collecting data) along a wellbore (101) to log the wellbore (101). Such properties may be related to one or both of wellbore fluid (109) within the wellbore (101) or a rock formation (115) in which the wellbore (101) is formed. The untethered devices (100) are unattached (e.g., either directly or indirectly) to a surface (103) from which the wellbore (101) extends. The untethered devices (100) are deployable to the wellbore (101) to move (e.g., sink) in a downhole direction (105) through the wellbore fluid (109) while logging the wellbore (101) (e.g., refer to 100*a*), to sufficiently increase their buoyancy when the untethered logging devices (100) reach a target depth (111) along the wellbore (101) (e.g., refer to 100*b*), and to consequently move (e.g., rise) in an uphole direction (107) through the wellbore fluid (109) towards the surface (103) while logging the wellbore (101) (e.g., refer to 100*c*).

Figure 2A:
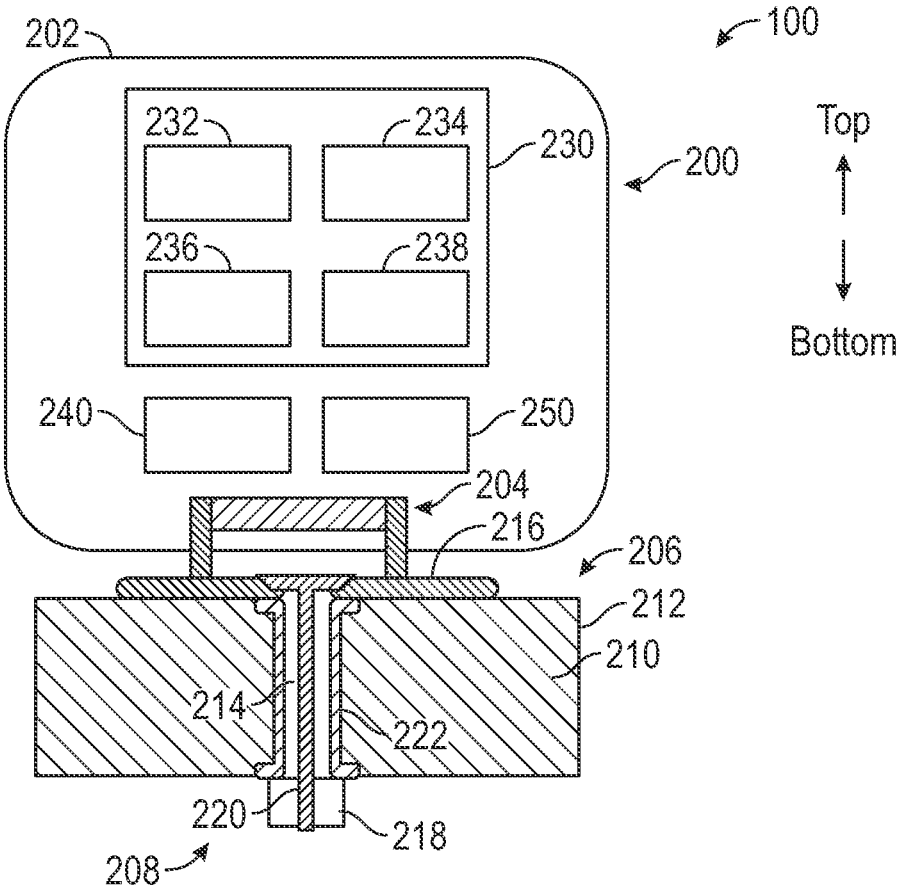
FIG. 2A shows a cross-sectional view of an example untethered device, in accordance with embodiments of the disclosure.

FIG. 2A shows a cross-sectional view of an example untethered device (100), in accordance with embodiments of the disclosure. The untethered device (100) includes a tool (200) and a ballast weight (206). A main housing (202) of the tool (200) contains or otherwise accommodates various internal components of the tool (200). The ballast weight (206) is coupled to a switchable magnet (204) of the tool (200). The main housing (202) may have any shape, e.g., a substantially frusto-spherical shape (i.e., the shape of a partial sphere) such that the untethered device (100) may sometimes be referred to as a sensor ball.

In one or more embodiments, the tool (200) includes circuitry (230) that controls various functionalities of the untethered device (100). In some embodiments, the circuitry (230) includes a receiver (232), a transmitter (234), a controller (236), and one or more processors (238). The tool (200) also includes a battery (240) that powers various components of the untethered device (100).

In one or more embodiments, the tool (200) includes one or more sensors (250) that may be powered by the battery (240). The sensor(s) (250) may measure one or more physical, chemical, geological, or structural properties along the wellbore (101) to log the wellbore (101). The measurements may be continuously performed. Example properties include elapsed time, temperature, pressure, fluid density, fluid viscosity, fluid flow rate, magnetic field, gamma ray intensity, tool acceleration, tool rotation, and other parameters. The continuous measurements may be acquired while the tool (200) both descends and ascends through the wellbore fluid (109). During the logging operation, the transmitter (224) may send data carrying the real-time measurements to one or more devices located at the surface (103) for further processing of the data. Alternatively, the data may be stored for later retrieval.

As previously noted, the untethered device (100) is configured to change its buoyancy in order to move in an uphole direction (107), e.g., after reaching a target depth (111). The change in buoyancy is achieved by releasing the ballast weight (206).

Releasing of the ballast weight (206) may be achieved in multiple different manners as subsequently described following a discussion of the components of the ballast weight (206).

In one or more embodiments, the ballast weight (206) includes a dissolvable ballast (210), an attachment plate (216), and attachment elements (208) that affix the dissolvable ballast (210) to the attachment plate (216).

The attachment plate (216) may be a metal plate that is made of one or more ferromagnetic materials, such as high-permeability, soft ferromagnetic materials (e.g., carbon steels or nickel-iron alloys). The resulting attractive force between the attachment plate (216) and the switchable magnet (204) ensures that the attachment plate (216) remains secured to the switchable magnet (204) until the switchable magnet (204) is operated to release the entire ballast weight (206) as a unit from the switchable magnet (204) of the untethered device (100).

The dissolvable ballast (210) may be made of one or more non-magnetic materials, such as aluminum, magnesium, or a metal polymer composite material. The dissolvable ballast (210) may have a weight between 50 g and 200 g, or any other weight, without departing from the disclosure. The size of the dissolvable ballast (210) may be determined by the wellbore geometry and the design of the other elements of the untethered device. The diameter and height of a dissolvable ballast (210) with a cylindrical shape may be between 0.5 and 2 inches, although other regular and irregular shapes may be used without departing from the disclosure. The dissolvable ballast (210) may be coated with a coating (212) that initially surrounds an exposed exterior surface of the dissolvable ballast (210) to slow down or otherwise delay the degrading process of the dissolvable ballast (210), thereby suppressing the exothermic heat generation and byproduct formation associated with the dissolution of the dissolvable ballast (210) for several hours to days depending on the thickness of the coating (212). This delay provides a window for the untethered device (100) to operate without excessive heat and byproduct formation. The presence of the coating (212) may further ensure that the untethered device (100) sinks to the target depth (111) before the dissolvable ballast (210) can sufficiently degrade to critically reduce the overall density of the untethered device (100).

The coating (212) may be made of one or more materials, such as a polymer (e.g., epoxy or xylan) or an oxide (e.g., alumina or silica). The thickness of the coating (212) may be between 10 μm and 1 mm. The coating (212) may have any other thickness, without departing from the disclosure. Thicker coating delays the dissolution further. The coating (212) may be applied to the dissolvable ballast (210) by utilizing techniques such as dip coating, spray coating, anodization, electrodeposition, vapor deposition, etc.

Continuing with the discussion of the releasing of the ballast weight (206), the ballast weight (206) may be released by switching the switchable magnet (204) from a state in which the ballast weight (206) is magnetically held at the attachment plate (216) of the ballast weight (206) to a state in which the attachment plate (216) is no longer held by the switchable magnet (204), thereby releasing the ballast weight (206).

In one or more embodiments, the switchable magnet (204) includes permanent magnets and an electromagnetic actuator. For example, the switchable magnet (204) may include two permanent magnets connected in parallel. One of the permanent magnets may be made of a material that has a higher coercivity or resistance to having its magnetization direction reversed (e.g., a Neodymium magnet). The second permanent magnet may be made of a material that has a lower coercivity or resistance to having its magnetization direction reversed, and therefore can have its polarization direction changed easily (e.g., an aluminum nickel cobalt (AlNiCo) magnet). The size and material of the two permanent magnets may be selected so that they have essentially the same magnetic strength, i.e., remnant magnetization.

In one embodiment, a coil of wire is wrapped around the lower coercivity magnet, i.e., the second permanent magnet. In another embodiment, a coil may be wrapped around both magnets, since the higher coercivity magnet is chosen such that it will not be repolarized by the field produced by the coil of wire. In another embodiment, there are an even number of magnets, e.g., two, four, or more, all of the same low coercivity material (such as AlNiCo) and the same dimensions. The coil of wire is wrapped around half of the magnets, such that only half of the magnets have polarization switched by the coil. Making all magnets of the same low coercivity material simplifies the matching of the magnetic strength of the repolarized and unrepolarized magnets. This helps to ensure field cancellation in the polarization or off state, as a failure to completely cancel the fields in the polarization state may result in a failure to decouple from a surface, such as the ballast.

A pulse or pulse sequence applied to the coil of wire in a second direction reverses the polarization of the low coercivity magnet, e.g., the second permanent magnet, in the opposite direction from the high coercivity magnet, e.g., the first permanent magnet. This is described herein as the internal flux or off state, as the magnetic flux travels in a loop through the two permanent magnets, but does not substantially extend outside the switchable magnet (204). This allows the untethered device (100) to decouple from a ferromagnetic surface, such as the attachment plate (216) of the ballast weight (206).

The decoupling (e.g., referring to 100*b* in FIG. 1) may occur at the target depth (111) (e.g., a preprogrammed depth that is detected based on a sensor measurement). Upon release of the ballast weight (206) from the switchable magnet (204), an overall (e.g., bulk) density of the untethered device (100) decreases (e.g., instantaneously) to a value that is less than that of the wellbore fluid (109). Accordingly, the untethered device (100) (e.g., the functional module remaining after release of the ballast weight (206)) is buoyant enough to float in the uphole direction (207) (e.g., referring to 100*c* in FIG. 1) to be retrieved at the surface (103). In this way, connection or disconnection of the ballast weight (206) governs whether the untethered device (100) descends (e.g., sinks) in the downhole direction (105) or ascends (e.g., floats upward) in the uphole direction (107) through the wellbore fluid (109).

While the tool (200) of untethered device (100) floats upward, the ballast weight (206) continues to descend, frequently as a unit, toward the bottomhole end (113) of the wellbore (101) (e.g., referring to 100*d* in FIG. 1). While the ballast weight (206) remains in the wellbore (101), the dissolvable ballast (210) gradually degrades over an extended period of time (e.g., several hours to several days).

The release of the ballast weight (206) by operating the switchable magnet (204) may be considered a primary release mechanism. A secondary release mechanism, different from the primary release mechanism, is subsequently described. The secondary release mechanism may be relied upon if the primary release mechanism fails or is not used for other reasons.

The secondary release mechanism, in one or more embodiments, is enabled by dissolution of one or more of the attachment elements (208). Even when the switchable magnet (204) remains activated, the dissolvable ballast (210) may be released, while the attachment plate (216) may remain attached to the switchable magnet (204).

In one or more embodiments, the attachment elements (208) include a dissolvable nut (218) configured to dissolve faster than the dissolvable ballast (210), and a screw (220) that is mechanically engaged with the attachment plate (216). The screw may pass through a clearance hole (214) in the dissolvable ballast (210). The combination of the screw (220) and the dissolvable nut (218) secure the dissolvable ballast to the attachment plate (216). The dissolvable nut (218) may be several times smaller than the dissolvable ballast (210), thereby ensuring that the dissolvable nut (218) dissolves prior to the dissolvable ballast (210). Furthermore, a coating of the nut may be thinner than a coating elsewhere. A cylindrical nut may have a diameter and height between, for example, 0.05 and 1 in. Other geometries such as hexagon or square shapes may be used. The dissolvable nut (218) may be made of any material that is dissolvable under the environmental conditions present in the downhole environment. Examples of materials include, but are not limited to aluminum, magnesium, and dissolvable polymer materials.

The dissolvable nut (218) may be configured to dissolve within a few hours, and once the nut (218) has dissolved, the dissolvable ballast (210) is released from the attachment plate (216), while the attachment plate (216) remains attached to the switchable magnet (204). The release of the dissolvable ballast (210) is further described below in reference to FIG. 3.

The gradual dissolution of the dissolvable ballast (210) may produce a mud-like byproduct. The byproduct may have a viscosity that is sufficiently high to potentially immobilize the screw (220), even after dissolution of the dissolvable nut (218), and thereby preventing the separation of the dissolvable ballast (210) from the attachment plate (216), unless the screw (220) is protected from exposure to the byproduct.

In one or more embodiments, the attachment elements (208) further include a sleeve (222). The sleeve (222) may be inserted in the center of the dissolvable ballast (210). The sleeve (222) may form a barrier between the dissolvable ballast (210) and the screw (220) to prevent byproduct formation around the screw (220). Accordingly, the risk of the screw (220) getting stuck in the viscous byproduct is eliminated.

The sleeve (222) may be made of a non-dissolving or very slowly dissolving material (dissolving rate <0.01 g/day). For example, steel or plastics such as PEEK, PC, or Nylon may be used. The sleeve (222) may have rounded corners to ensure that the thread on the screw does not have any place to anchor and slides easily during the release. A sleeve (222) may alternatively be formed by coating the inside surface of the screw hole which may provide a smooth surface and may further avoiding leaving large solid (>1 mm) in the well. By using a thicker coating than on the nut, the dissolving may be controlled to occur from outer to inner body of the nut, thereby preventing clogging of the screw.

Figure 2B:
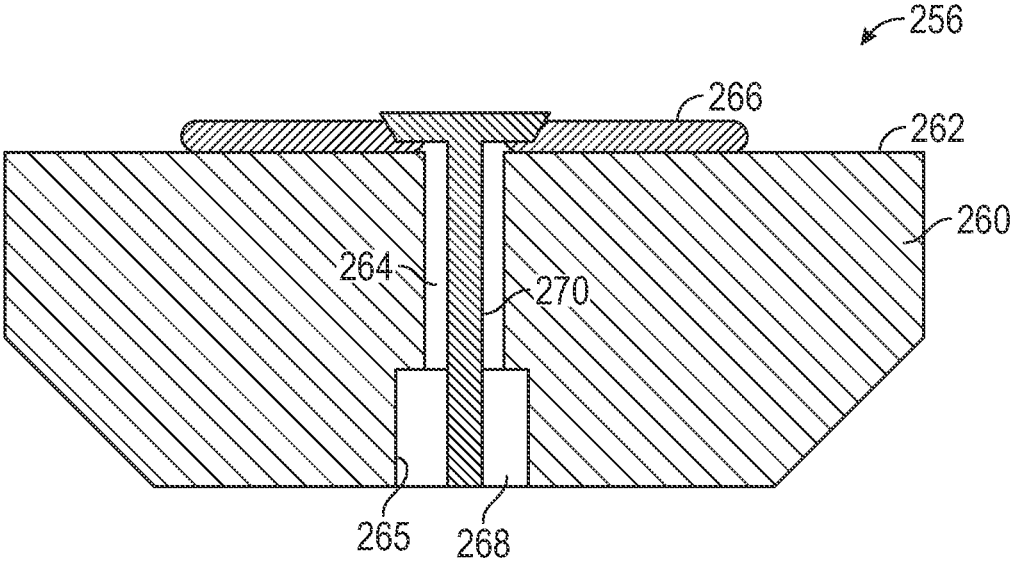
FIG. 2B shows a cross-sectional view of an example ballast weight, in accordance with embodiments of the disclosure.

FIG. 2B shows a cross-sectional view of an example ballast weight (256), in accordance with embodiments of the disclosure. The ballast weight (256) includes a dissolvable ballast (260), a coating (262), an attachment plate (266), a screw (270), and a dissolvable nut (268). Unlike the embodiment shown in FIG. 2A, the ballast weight (256) does not include a sleeve, thereby further minimizing the potential waste left in the well.

In one or more embodiments, the dissolvable nut (268) is disposed in a recess (265) of the dissolvable ballast (260). The dissolvable nut may be coated with a coating (262) on all sides except the bottom side that is directly exposed to borehole fluids. Further, the dissolvable ballast (260) is coated inside the clearance hole (164), thereby preventing early dissolution of the dissolvable ballast (260) from the inside of the clearance hole (264). The downward facing exposed (non-coated) surface of the dissolvable nut (268) may be flush with the base of the coated dissolvable ballast (260). The coating (262) around the dissolvable nut (268) may ensure that the dissolved waste does not propagate upward towards the screw hole thereby preventing clogging of the screw (270) in place. The coating at the curved surface (cylindrical nut) of the dissolvable nut (268) may be coated or it may rely on the coating at the inner surface of the dissolvable ballast (260).

Figure 2C:
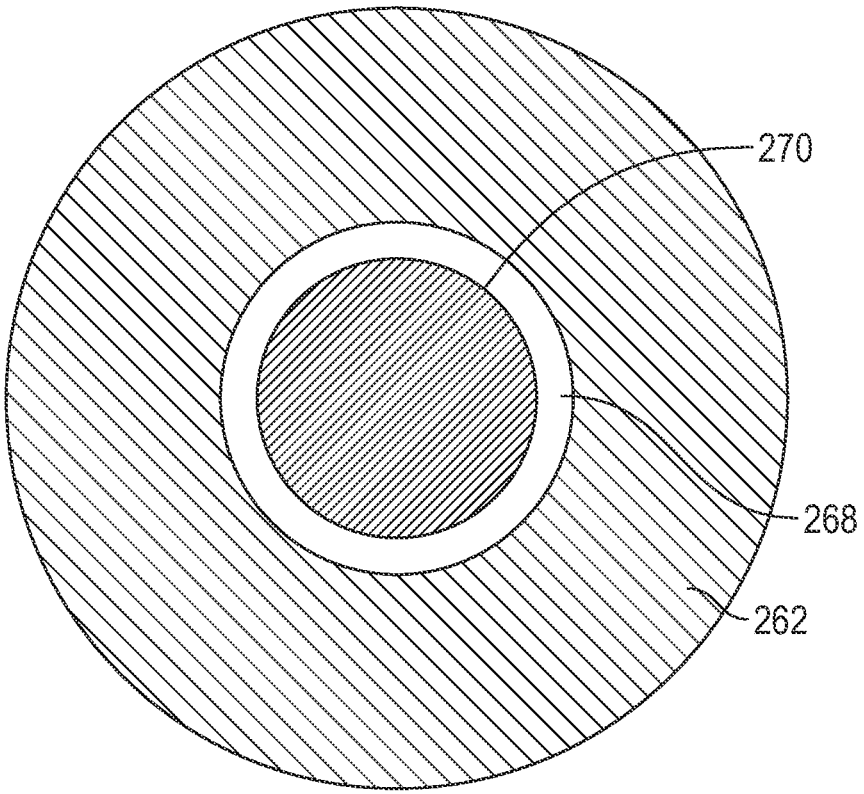
FIG. 2C shows a top view of an example dissolvable nut, in accordance with embodiments of the disclosure.

FIG. 2C shows a top view of an example dissolvable nut (268), in accordance with embodiments of the disclosure. The dissolvable nut (268) may be the dissolvable nut (268) used in the example shown in FIG. 2B. As shown in FIG. 2C, there is a gap in the coating (262) of the top side of the dissolvable nut (268) to avoid direct contact of the coating (262) with the screw (270), thereby preventing the coating (262) from holding the screw (270) in place after dissolution of the dissolvable nut (268).

While FIGS. 2A, 2B, and 2C show various configurations of components, other configurations may be used without departing from the scope of the disclosure. For example, various components in FIGS. 2A, 2B, and 2C may be combined to create a single component. As another example, the functionality performed by a single component may be performed by two or more components. Also, while a dissolvable nut disposed in a screw is described, other dissolvable attachment elements may be used without departing from the disclosure.

Figure 3:
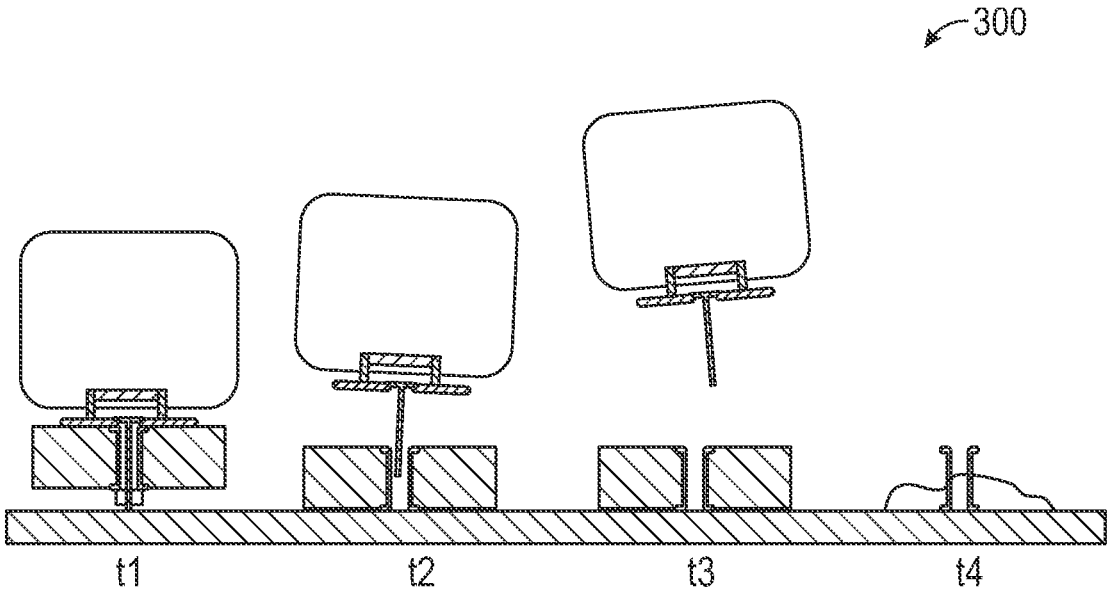
FIG. 3 shows snapshots of a release of a ballast weight, in accordance with embodiments of the disclosure.

FIG. 3 shows snapshots (300) of a release of a ballast weight, in accordance with embodiments of the disclosure. The release of the ballast weight is based on a secondary release mechanism, e.g., when the primary release mechanism has failed or is not used for other reasons. Specifically referring to the timeline shown in FIG. 3, at t1, the untethered device is in its original condition, with the dissolvable ballast connected to the attachment plate, and the dissolvable nut in an undissolved state. At t2, e.g., a few hours after t1, the dissolvable nut has dissolved and enables separation of the dissolvable ballast from the attachment plate. Thus, the tool may be released before the dissolvable ballast starts to dissolve. At 13, the tool, separated from the dissolvable ballast, may be floating in an upward direction. t3 may be immediately after t2. At t3, the dissolvable ballast may be mostly or entirely undissolved, thereby not exposing the tool to the exothermic heat that may be a result of the dissolution of the dissolvable ballast. At t4, the ballast is dissolving. Depending on the type of material, a sleeve may be left behind.

Figure 4:
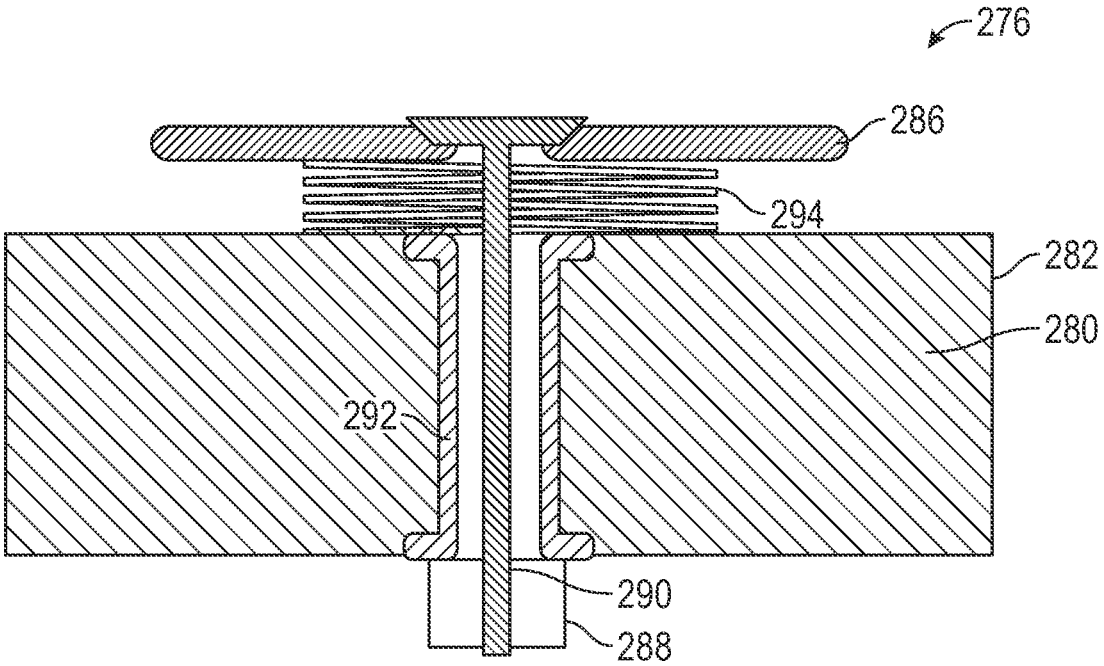
FIG. 4 shows a cross-sectional view of an example ballast weight, in accordance with embodiments of the disclosure.

FIG. 4 shows a cross-sectional view of an example ballast weight (276), in accordance with embodiments of the disclosure. The ballast weight (276) may be substantially similar to the ballast weight of FIG. 2A. Components that may be as described in reference to FIG. 2A include, for example, the attachment plate (286), the dissolvable ballast (280), the coating (282), the screw (290), the dissolvable nut (288), and the sleeve (292). In one embodiment, the ballast weight (276) further includes a compression spring (294) between the attachment plate (286) and the dissolvable ballast (280). The compression spring (294) may be compressed by the engagement of screw (290) and the dissolvable nut (288). When the dissolvable nut (288) dissolves, the compression spring (294) may expand and push the tool (200) away from the ballast weight (276). This may be particularly beneficial when the buoyant force is possibly smaller than frictional or viscous forces that can prevent the tool (200) from rising in the fluid column.

Figure 5:
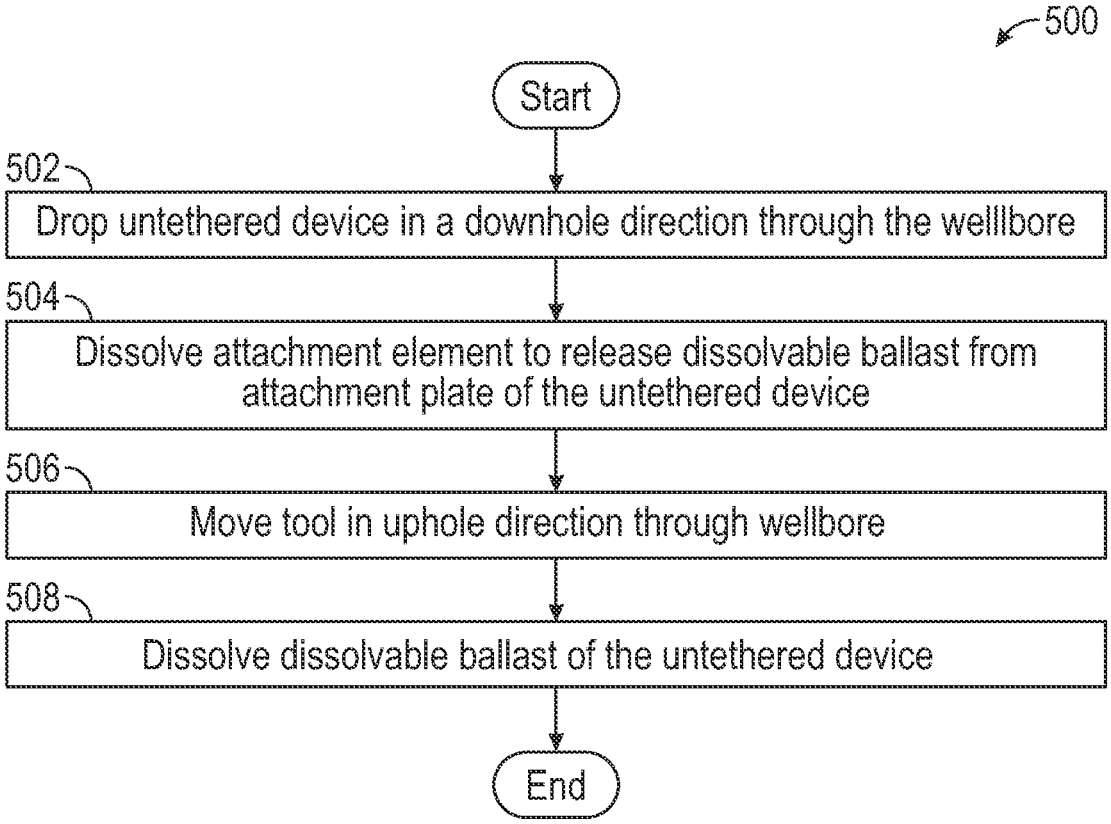
FIG. 5 shows a flowchart for a method in accordance with embodiments of the disclosure.

FIG. 5 shows a flowchart for a method (500) in accordance with embodiments of the disclosure. The method (500) may be used for logging a wellbore. While the various steps in FIG. 5 are presented and described sequentially, one of ordinary skill in the art will appreciate that some or all of the steps may be executed in different orders, may be combined or omitted, and some or all of the blocks may be executed in parallel. Furthermore, the steps may be performed actively or passively.

In Step 502, an untethered device is dropped in a downhole direction through the wellbore. The untethered device may be as previously described. The untethered device may be an untethered logging device.

In Step 504, an attachment element is dissolved to release a dissolvable ballast from an attachment plate of the untethered device. The attachment element that is dissolved may be a dissolvable nut that is disposed on a screw that fastens the dissolvable ballast to the attachment plate. A compression spring may facilitate the separation of the dissolvable ballast from the attachment plate, as previously described.

Step 504 may occur after a release of the attachment plate by a switchable magnet has failed or has not been performed for other reasons.

In Step 506, the tool moves (e.g., rises) in an uphole direction through the wellbore.

In Step 508, the dissolvable ballast of the untethered device is dissolved.

The tool may measure one or more properties within the well bore while Steps 502-508 are performed.

Embodiments of the disclosure have one or more of the following benefits. If the ballast release by the switchable magnet fails, the tool may, nevertheless, regain its buoyancy without excessive delay, because the regaining of the buoyancy does not depend on a dissolution of the dissolvable ballast. Furthermore, the tool avoids close proximity to the dissolvable ballast during dissolution of the dissolvable ballast. This may protect the tool from exposure to heat associated with the exothermic dissolution of the dissolvable ballast, which could potentially cause heat damage and/or corruption of temperature measurements. Also, embodiments of the disclosure avoid issues with emerging byproducts of the dissolving ballast that can form a muddy aggregate which may reach a volume where the tool can be immobilized due to the large viscosity of the mud.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. An untethered device comprising:

a tool;

at least one sensor for measuring one or more properties along a wellbore; and a ballast weight comprising:

an attachment plate that is securable to the tool,
a dissolvable ballast, and
attachment elements that secure the dissolvable ballast to the attachment plate,
wherein at least one of the attachment elements is dissolvable to release the dissolvable ballast from the attachment plate.

2. The untethered device of claim 1,
wherein the at least one of the attachment elements is configured to dissolve faster than the dissolvable ballast.

3. The untethered device of claim 1,
wherein the attachment elements comprise:
a screw disposed on the attachment plate, the screw passing through a clearance hole in the dissolvable ballast, and
a dissolvable nut disposed on the screw.

4. The untethered device of claim 3,
wherein the ballast weight further comprises a sleeve that forms a barrier between the dissolvable ballast and the screw.

5. The untethered device of claim 3,
wherein the dissolvable nut is disposed in a recess of the dissolvable ballast.

6. The untethered device of claim 5, wherein the dissolvable ballast is coated with a coating in the clearance hole.

7. The untethered device of claim 3, wherein the dissolvable nut is made of one selected from a group consisting of aluminum, magnesium, and dissolvable polymer materials.

8. The untethered device of claim 1,
wherein the ballast weight further comprises a coating disposed on the dissolvable ballast, the coating configured to delay dissolution of the dissolvable ballast.

9. The untethered device of claim 1, wherein the ballast weight further comprises a compression spring between the attachment plate and the dissolvable ballast.

10. The untethered device of claim 1, further comprising a switchable magnet, for switchably releasing the ballast weight.

11. The untethered device of claim 1, wherein the untethered device is configured to continuously log a surrounding wellbore while the untethered device moves in a downhole direction and while the untethered device moves in an uphole direction.

12. The untethered device of claim 1, wherein the untethered device comprises an untethered logging device.

13. The device of claim 1, wherein the attachment plate is removably secured to the tool.

14. A method for logging a wellbore, the method comprising:
dropping an untethered device in a downhole direction through the wellbore, the untethered device comprising:
a tool, and
a ballast weight comprising:
an attachment plate that is securable to the tool,
a dissolvable ballast, and
attachment elements that secure the dissolvable ballast to the attachment plate, dissolving an attachment element to release the dissolvable ballast from the attachment plate; and
moving the tool in an uphole direction through the wellbore.

15. The method of claim 14, wherein the attachment element is a dissolvable nut that is disposed on a screw that fastens the dissolvable ballast to the attachment plate.

16. The method of claim 14, further comprising, after dissolving the attachment element:
separating the dissolvable ballast from the attachment plate by a compression spring.

17. The method of claim 14, further comprising:
dissolving the dissolvable ballast.

18. The method of claim 14,
wherein the attachment element is configured to dissolve faster than the dissolvable ballast.

19. The method of claim 14, further comprising measuring one or more properties within the wellbore while the tool moves in the downhole direction and in the uphole direction.

20. The method of claim 14, wherein the dissolving of the attachment element occurs after failing to release the attachment plate by a switchable magnet for switchably releasing the ballast weight.

* * * * *